US007946882B2

(12) United States Patent
Wu

(10) Patent No.: US 7,946,882 B2
(45) Date of Patent: May 24, 2011

(54) ELECTRICAL CONNECTOR ASSEMBLY WITH A GROUNDING PAD

(75) Inventor: Chun-Kwan Wu, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/569,906

(22) Filed: Sep. 30, 2009

(65) Prior Publication Data

US 2010/0227502 A1 Sep. 9, 2010

(51) Int. Cl.
*H00R 13/648* (2006.01)

(52) U.S. Cl. ... 439/497; 439/579; 439/108; 439/607.34; 439/607.41

(58) Field of Classification Search ..... 439/497, 439/579, 108, 607.34, 607.41
See application file for complete search history.

(56) References Cited

U.S. PATENT DOCUMENTS

| | | | | |
|---|---|---|---|---|
| 7,134,907 | B2 * | 11/2006 | Watanabe et al. | 439/495 |
| 7,207,842 | B1 * | 4/2007 | Kenjo | 439/607.01 |
| 7,220,146 | B2 * | 5/2007 | Miyazaki | 439/579 |
| 7,377,803 | B2 * | 5/2008 | Matsuoka | 439/497 |
| 7,422,488 | B1 * | 9/2008 | Wu | 439/676 |
| 7,578,705 | B2 * | 8/2009 | He et al. | 439/660 |
| 7,722,387 | B2 * | 5/2010 | Yamaji et al. | 439/497 |
| 2006/0172589 | A1 * | 8/2006 | Watanabe et al. | 439/495 |
| 2009/0117784 | A1 * | 5/2009 | Wu | 439/660 |

* cited by examiner

*Primary Examiner* — Gary F. Paumen
(74) *Attorney, Agent, or Firm* — Ming Chieh Chang; Wei Te Chung; Andrew C. Cheng

(57) ABSTRACT

An electrical connector assembly includes a first and second connector (A, B) engaged with each other. The first connector includes a first housing (20) with a middle plate (205), a number of first contacts (50) arranged into the first housing, a shield shell (10) surrounding the first housing. The second connector includes a second housing (60) defining a receiving slot (603), in which the middle plate of the first housing is seated, a number of second contacts (80) electrically connected to the first contacts in the receiving slot, a grounding element (70) assembled into the second housing and engaged with the shield shell.

14 Claims, 14 Drawing Sheets

ELECTRICAL CONNECTOR ASSEMBLY WITH A GROUNDING PAD

BACKGROUND OF THE INVENTION

1. Field of the Invention

The present invention relates to an electrical connector assembly, and more particularly to an electrical connector assembly with a grounding pad.

2. Description of the Related Art

As the mobile phone used in many and many people, the functions of the mobile phones is more and more strong, especially the GPS (Global Positioning System) is applied to the mobile phones. Therefore, a transmission frequency of the mobile phones is requiring more and more improve.

A micro-coaxial connector is mounted on a hinge of a mobile phone and used to transmit signal. The micro-coaxial connector comprises an insulating housing with a plurality of terminal contacts and shielding shell covering the outside of the insulating housing. Each terminal contact has an engaging section adapted for electrical connecting with an opposite connector and a conductor section adapted for electrical connecting with a cable.

BRIEF SUMMARY OF THE INVENTION

It is an object of the present invention to provide an electrical connector assembly with a grounding pad engaging with a metallic shell.

In order to achieve the objective above, an electrical connector assembly comprises a first and second connector engaged with each other. The first connector comprises a first housing with a middle plate, a plurality of first terminal contacts arranged into the first housing, a shield shell surrounding the first housing. The second connector comprises a second housing with a receiving slot in which said middle plate of the first housing is seated, a plurality of second terminal contacts electrically interconnected with the first terminal contacts in the receiving slot, a grounding element assembled into the second housing and engaged with the shield shell.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

In the following detailed description, for purposes of explanation, numerous specific details are set forth in order to provide a thorough understanding of the present invention.

Figure 1:
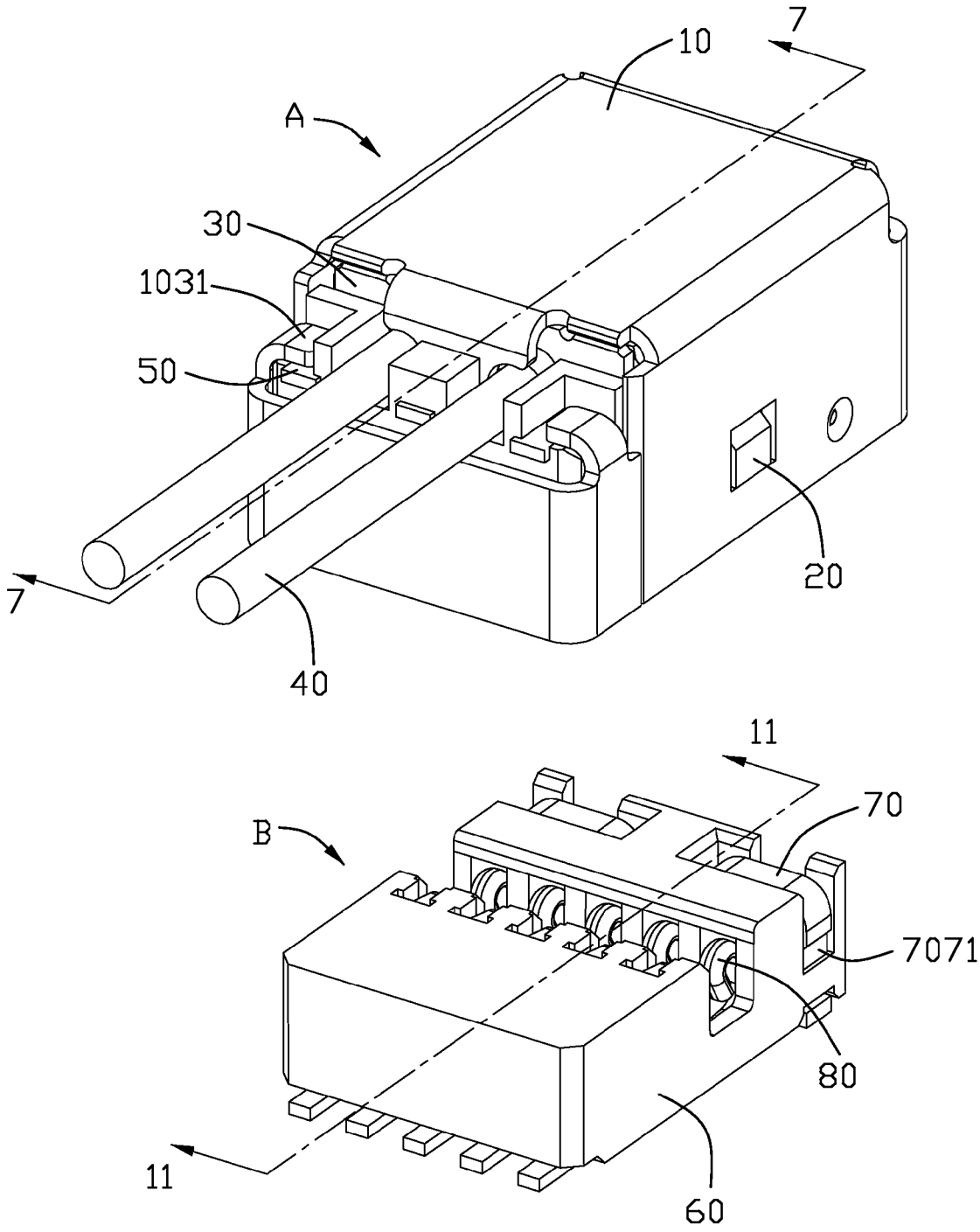
FIG. 1 is a perspective view of an electrical connector assembly according to the embodiment of the present invention, wherein the first and second connectors are not engaged with each other.
Figure 2:
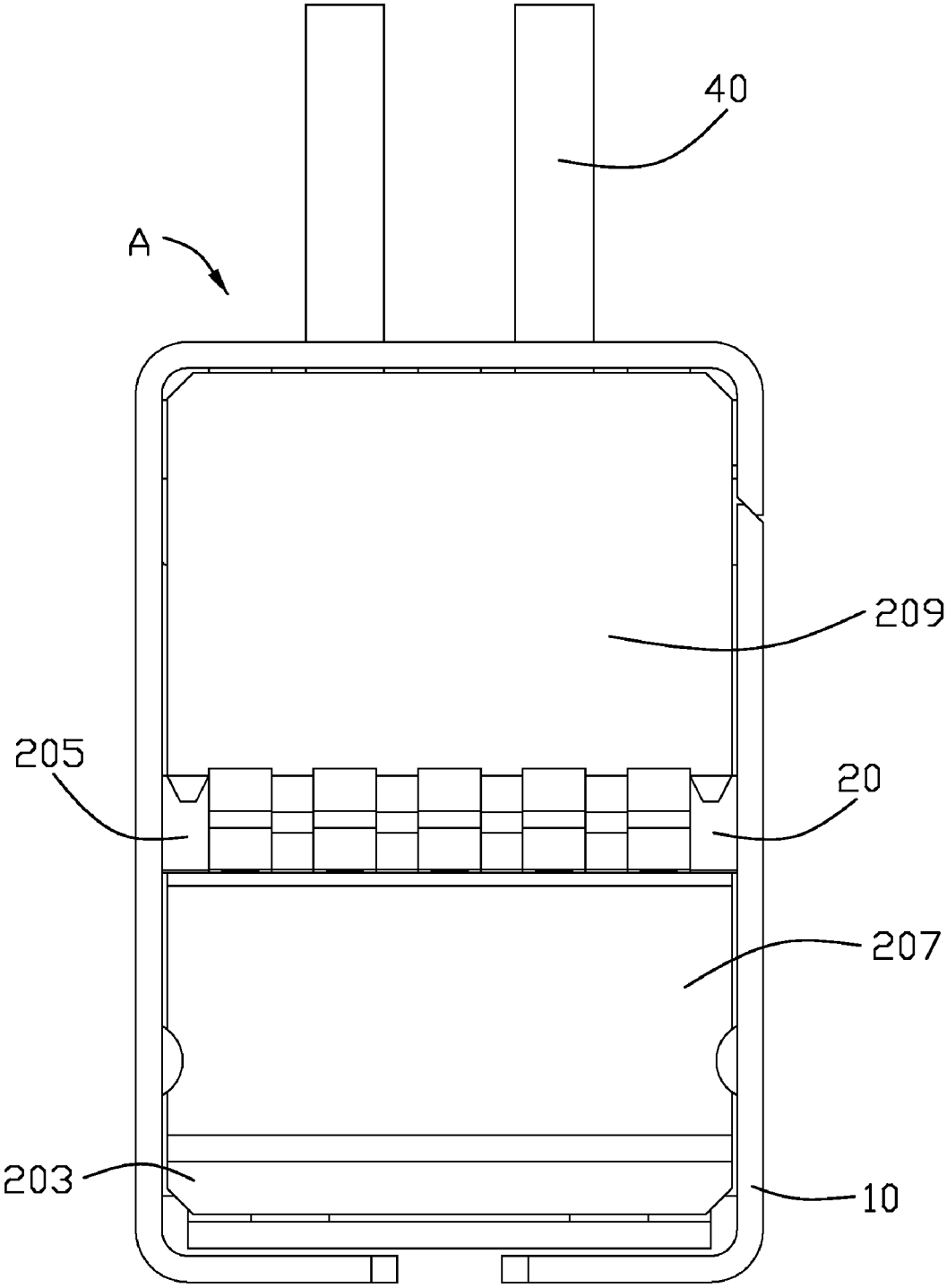
FIG. 2 is a top view of the first connector of FIG. 1.
Figure 3:
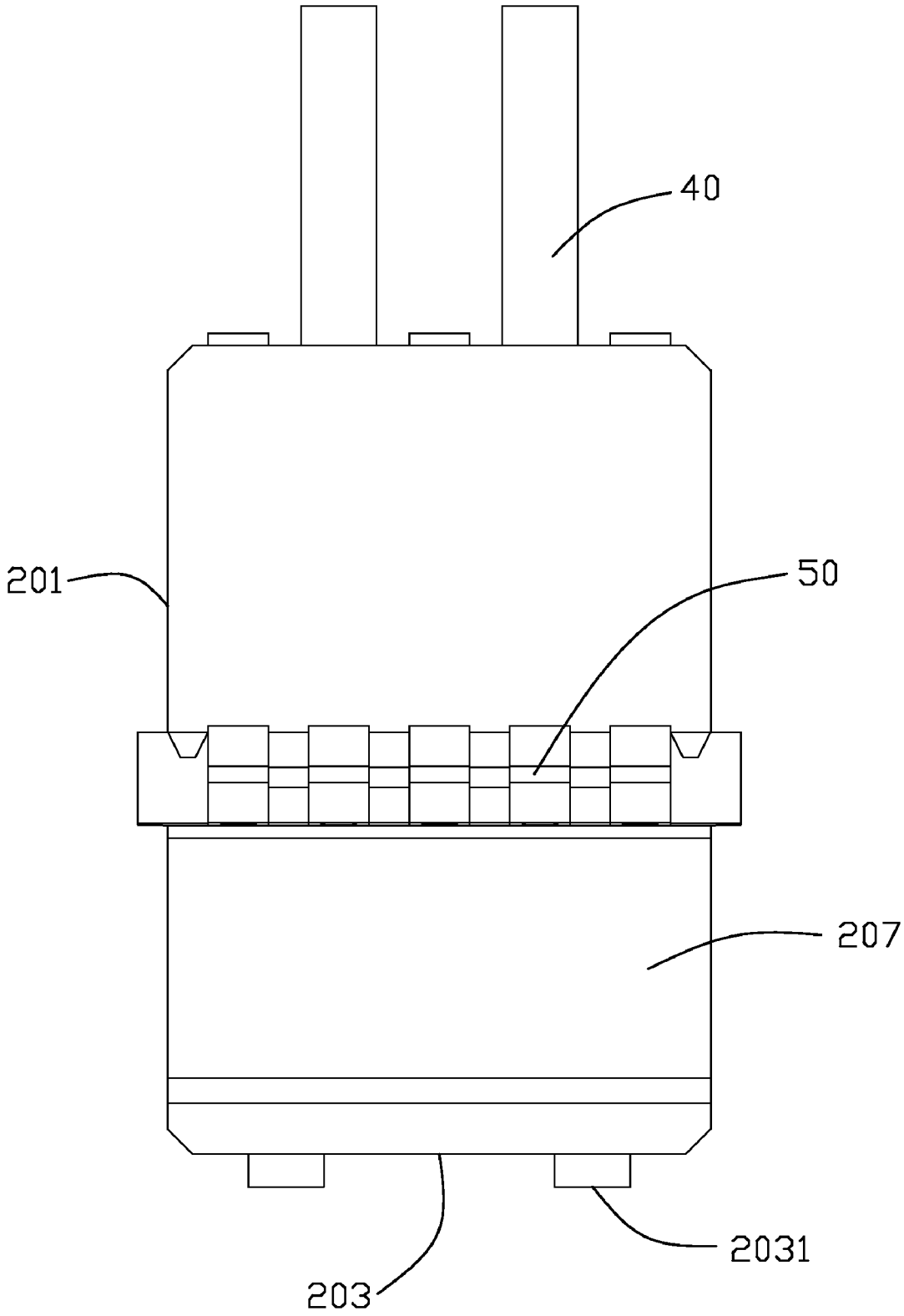
FIG. 3 is similar with FIG. 2, while the metallic shell is not shown.

Please refer to FIG. 1, an electrical connector assembly includes a first connector A engaging with a second connector B. Please refer to FIGS. 2-6, the first connector comprises a first metallic shell 10, a first housing 20, a plurality of first terminals 50, a pair of cables 40 and a grounding bar 3.

Please still refer to FIGS. 2-7, the first housing 20 comprises a first bottom plate 201, a first upright plate 203 extending from an end edge of the first bottom plate 201 and a first middle plate 205 extending from a middle of a top surface of the first bottom plate 201 and parallel to the first upright plate 203, wherein the first upright plate 203 and the first middle plate locate on a same side of the first bottom plate 201 and a first receiving space is formed between the first upright plate 203 and the first middle plate 205 and a second receiving space 209 is adjacent to the first receiving space 207 and divided by the first middle plate 205.

Figure 6:
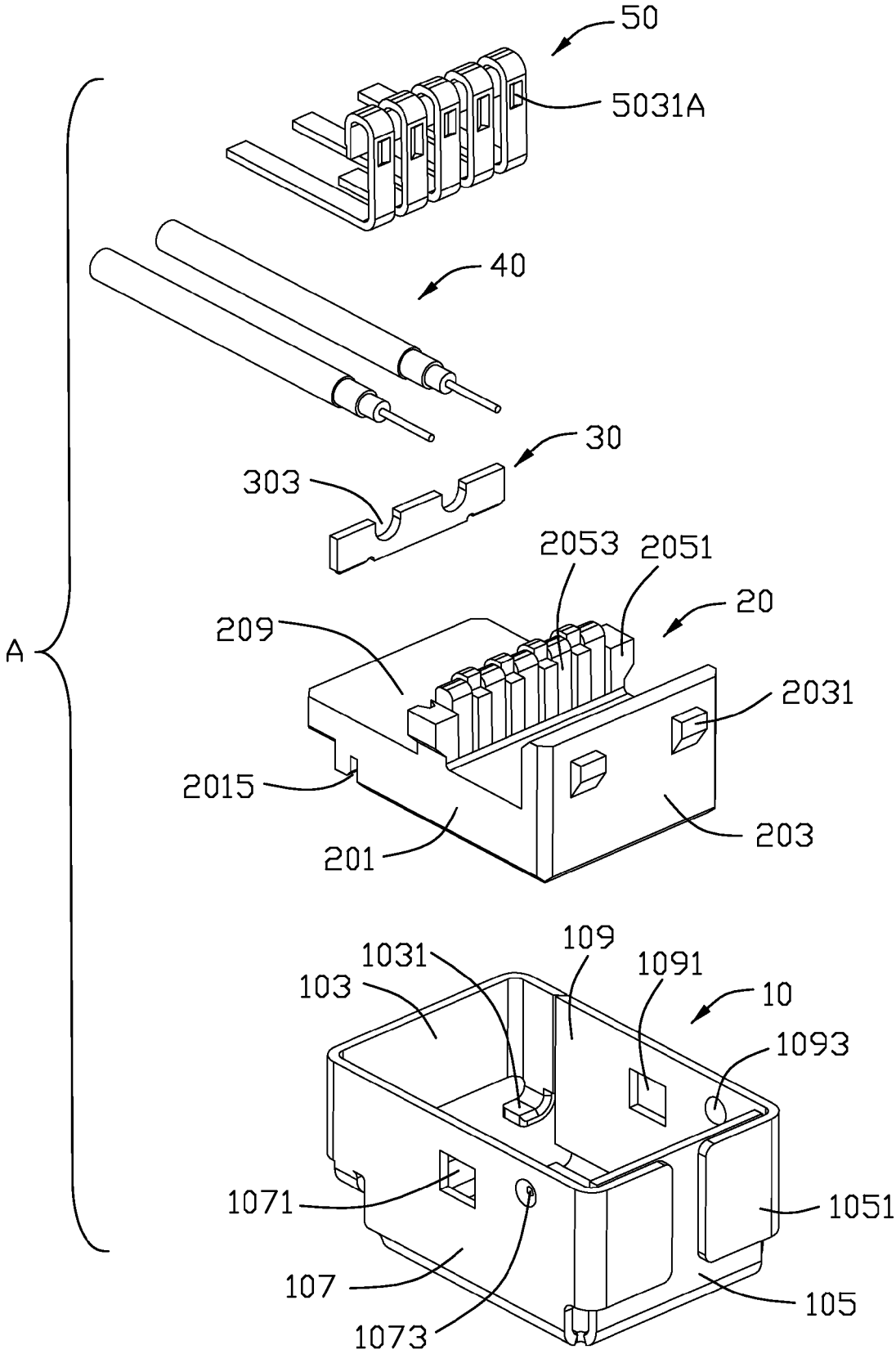
FIG. 6 is another exploded view of the first connector.
Figure 7:
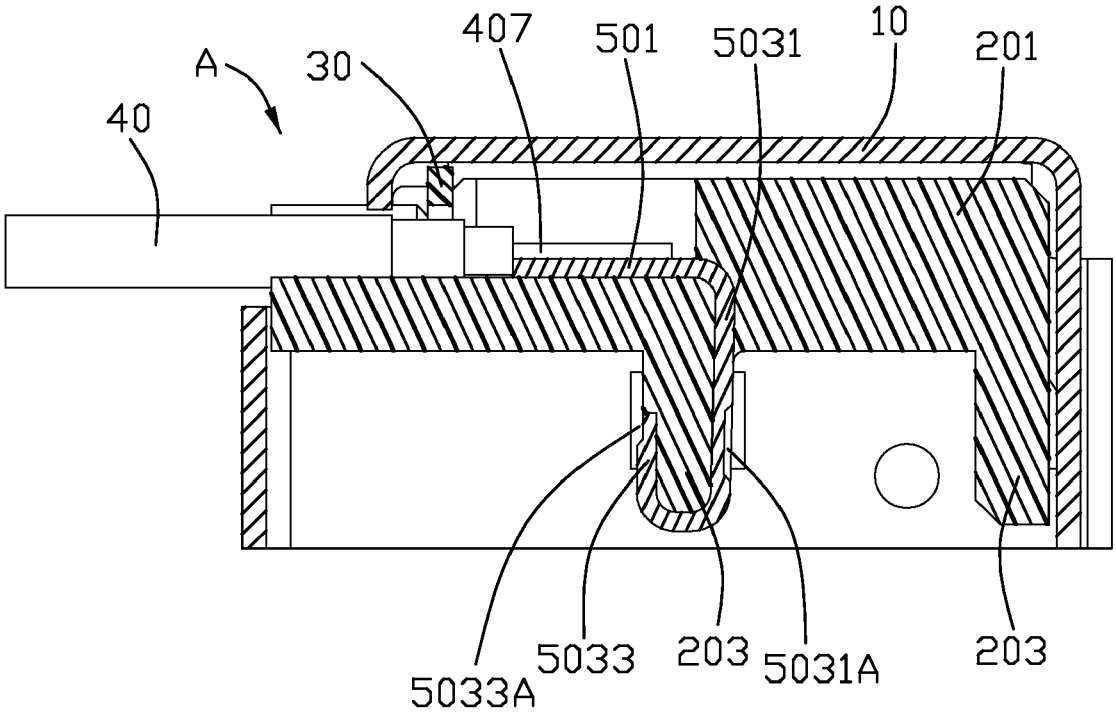
FIG. 7 is a cross-section view along line 7-7 of FIG. 1.

Please particularly refer to FIG. 6, an outside of the upright plate 203 defines a pair of first blocks 2031 protruding to outside adapted for engaging with the metallic shell 10. Similarly, the first middle plate 205 defines a pair of second blocks 2051 so as to engaging with the metallic shell 10. Furthermore, the first middle plate 205 defines a plurality of terminal passages 2053 extending from a surface thereof to an opposite surface thereof.

Figure 4:
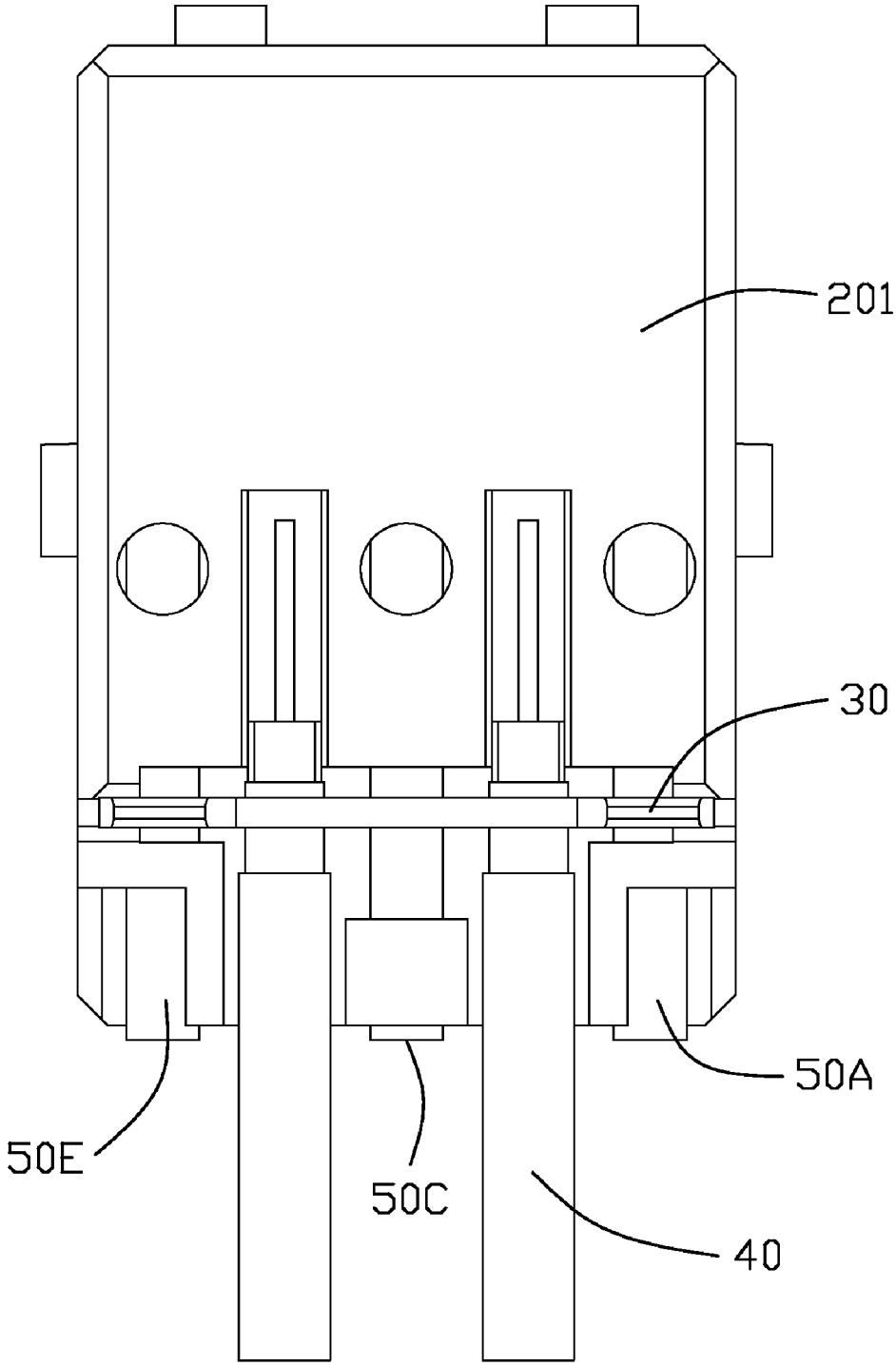
FIG. 4 is a below view of the first connector of FIG. 1.
Figure 5:
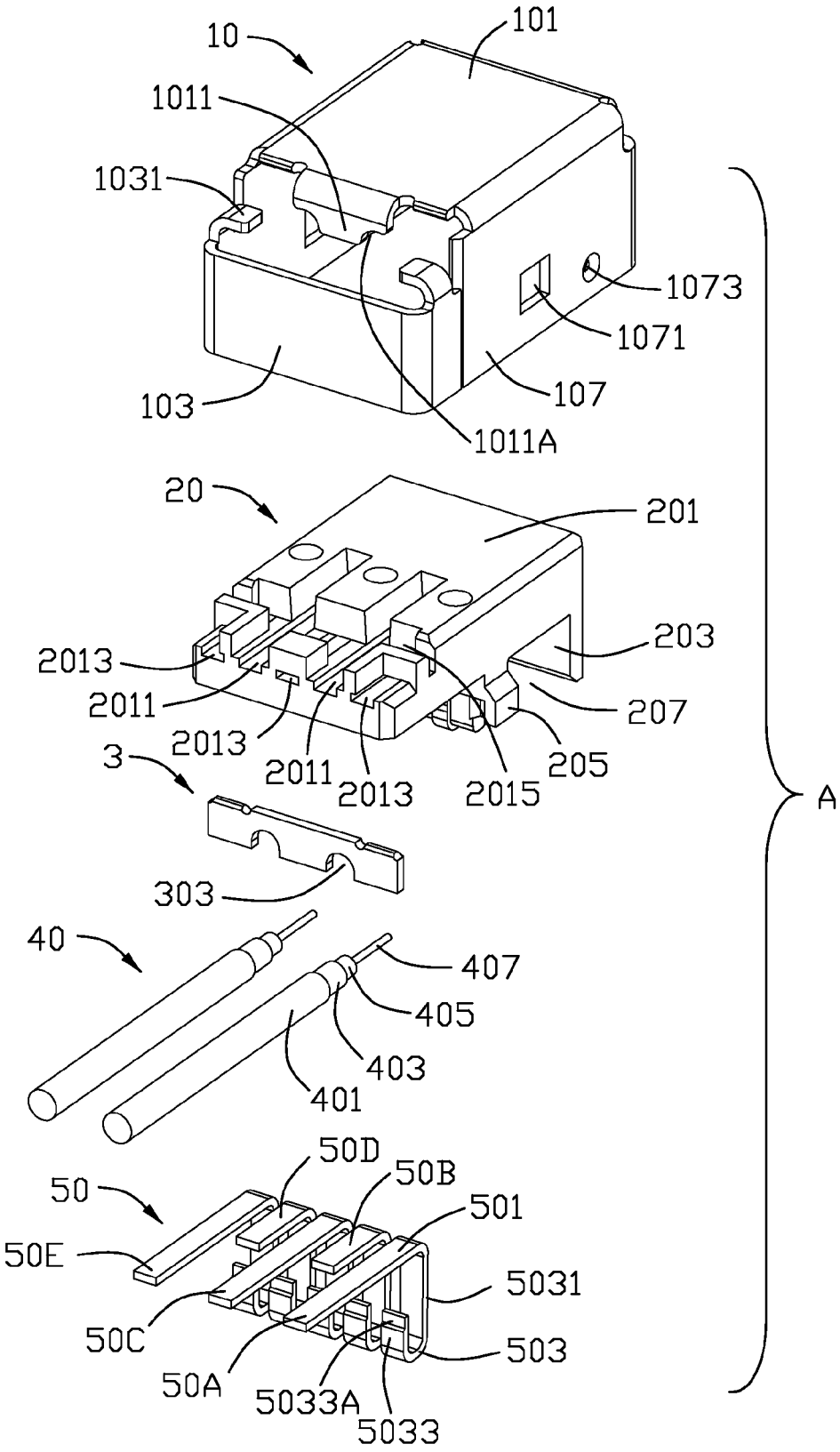
FIG. 5 is an exploded view of the first connector.

Please refer to FIGS. 4 and 5, a plurality of signal contact grooves 2011 and a plurality of grounding contact grooves 2013 are formed on bottom surface of the first bottom plate of the first housing 20 and arranged alternately. Additionally, the first bottom plate 201 defines a bar notch 2015 crossed to the signal contact grooves 2011 and the grounding contact grooves 2013.

The first terminal contacts includes two signal contacts 50B and 50D and three grounding contacts 50A, 50C and 50E. The configuration of the signal contacts 50B and 50D and the grounding contact 50A, 50C and 50E is completely same, each comprising a first soldering section 501 adapted for conductive connecting with the cable 40 and a first U-shaped section 503 interconnected with an end of the first soldering section 501. The first U-shaped section 503 includes a first leg 5031 interconnected with the first soldering section and a second leg 5033 opposite to the first leg 5031, wherein an out surface of the first leg 5031 defines a first indentation 5031A and an out surface of the second leg defines a second indention 5033A. The different between the signal contact and the grounding contact is that the length of the grounding contact is longer than that of the signal contact.

The metallic shell 10 comprises a top wall 101, a left wall 107, a right wall 109, a front wall 103 and a rear wall 105, each of the left wall 107, the right wall 109 and the front wall 103 connects with the top wall 101, while the front wall 103 is only interconnects with the left wall 107 and right wall 109 and separates to the top wall 101. Therefore, an edge of the front wall 103 and a corresponding edge of the top wall 101 forms an opening, and two opposite grounding pads 1031 are formed on the opening and integrated with the front wall 103 and each extending inwardly from a side edge of the front wall 103. Accordingly, the edge of the top wall 101 defines a tongue section 1011 extending downwardly and said grounding pads 1031 locates on two sides of the tongue section 1011, and two sides of the tongue section 1031 respectively defines a quarter-circle 1011A to match the cable 40. Furthermore, each of the left wall 107 and the right wall 109 defines a window 1071 and a protrude 1073 protruding into a center section of the metallic shell 10. More, two opposite bend portions 1051 are formed on a rear edge of the left wall 107 or right wall 109 and against a side surface of the rear wall 105.

Each of cables 40 comprises a body 401, a shielding 403, an insulating 405 and core 407 contacting to the first tail section 501 of the signal contact.

Grounding bar 30 is a metal board and mounted into the bar notch 2015, comprising a pair of semi-circle 303 on one edge end thereof for positioning the cables 40.

When assembling the first connector A, firstly, the first terminal contacts 50 are insert-molded into the first housing 20 with the first leg 5031 exposed into the first receiving space 207 and the second leg 5033 exposed into the second receiving space 209 and the first tail section 501 received into the corresponding grooves 2011 and 2013; secondly, the cable 40 are assembled onto the first housing 20 with the core 407 interconnected with the first tail section 501 of the signal contact 50B and 50D; thirdly, the grounding bar 3 is inserted into the bar notch 2015 of the first housing 20 and wherein the semi-circle 303 of the grounding bar 3 engaged with the corresponding portion of the cable 40; finally, the metallic shell 10 are covered on the surround of the first housing 20 with the second blocks 2051 engaging with the windows 1071 of the first housing 20 and the first blocks engaging with a corresponding windows of the first housing 20, besides, the tongue section 1011 contacting to a middle grounding contact and the grounding pads 1031 contacting to two sides grounding contacts.

Please refer to FIGS. 1 and 8-11, the second connector B includes a second housing 60 with a plurality of second terminal contacts 80 and a pair of grounding element 70.

The second housing 60 comprises two opposite ends 601 and 607 commonly defining a cavity 603 opening to top section and two sides section. An inner surface of the ends defines a plurality of second terminal passages 6031, in which the first terminal connected with the second terminal contacts. A through portion 6071 is formed on one of the ends and penetrated a top surface to bottom surface thereof and a concave portion 6073 is formed on the bottom surface thereof and crossed with the through portion 6071. Additionally, an opening section 6075 is formed on the top surface thereof and passing through the through portion 6071, moreover, said opening section 6075 exposed top and one side portion and the opening section 6075 and the through portion 6071 and the concave portion 6073 commonly receive the grounding element 70.

The second terminal contact 80 comprises a second tail section 801, a retaining section 803 extending uprightly from an edge end of the second tail section 801, an elastic section 807 and a bridge section 805 disposed between the retaining section 803 and the elastic section 807. The retaining section 803 defines a plurality of barbs 8031 on two side edges thereof adapted for fixing the second terminal contacts 80 into the second housing 60. The elastic section 807 is configured as a U-shape and defines a first contacting portion 8073 protruding into a center of the U-shape and a second contacting portion 8075 formed on a distal end thereof and opposite to the first contacting portion 8073.

The grounding element 70 comprises a mounting section 701, a horizontal section 705 parallel to the mounting section 701, a linking section 703 extending uprightly between the mounting section 701 and the horizontal section 705 and a contacting section 707 extending an end of the horizontal section 705 and perpendicular to the horizontal section 705 and a contacting point 7071 is formed on a distal end of the contacting section 707.

When assemble of the second connector B, the second terminal contacts 80 are received into the second terminal passages 6031 with the first and second contacting portions 8073 and 8075 exposed into the cavity 603 of the second housing 60. Then, the grounding elements 70 is mounted into a corresponding portion with the contacting point 707 of the grounding elements 70 exposed on side portion of the second housing 60.

Figure 13:
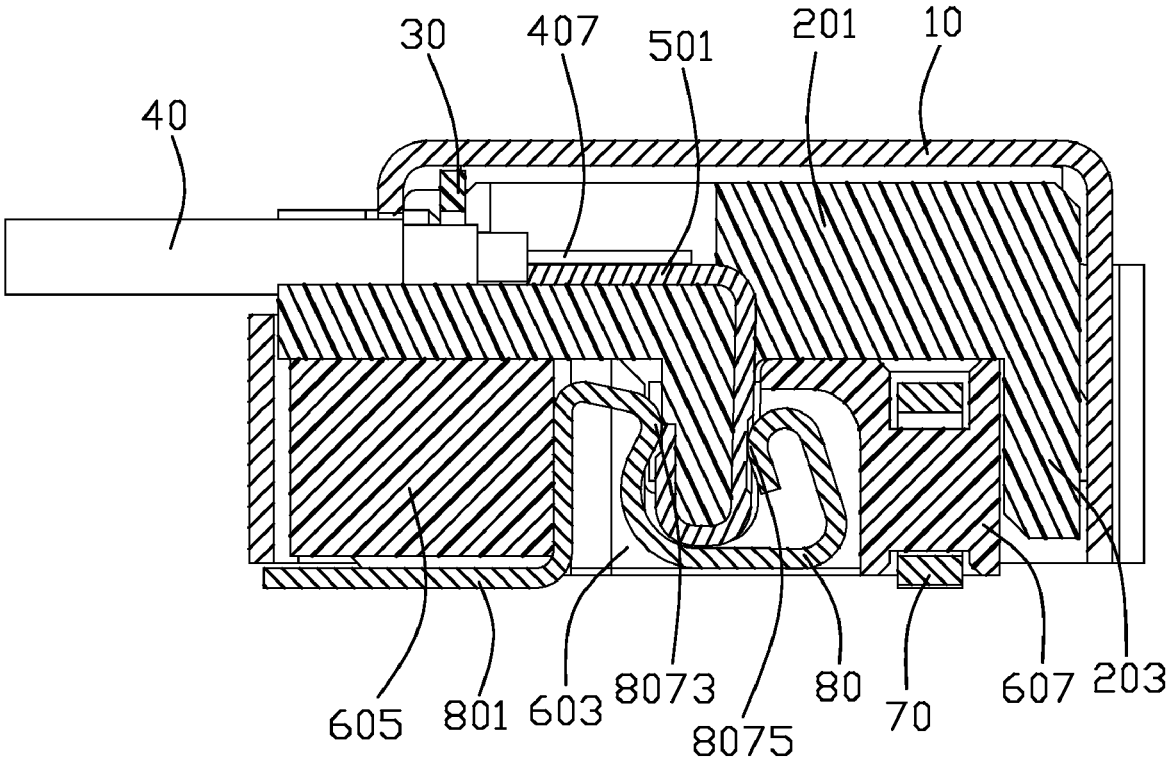
FIG. 13 is another cross-section of the electrical connector assembly according to the embodiment of the present invention.
Figure 14:
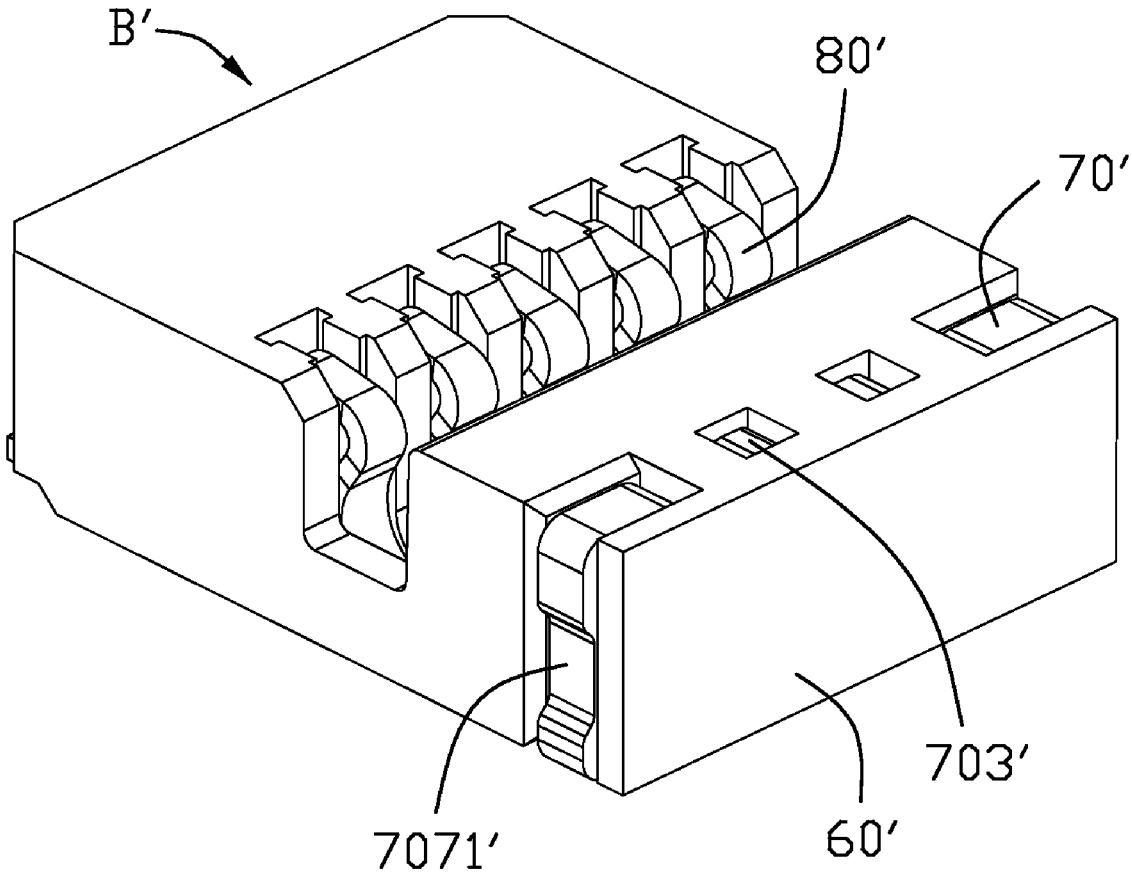
FIG. 14 is perspective view of the second connector according to another embodiment of the present invention.

When assembling the electrical connector assembly, please particularly refer to FIGS. 1 and 13, the first connector A is putted onto the second connector B from above, the middle upright wall 205 of the first connector A is seated into the cavity 603 of the second connector B and the first terminal 50 is electrically interconnected with the second terminal contacts 80.

Figure 8:
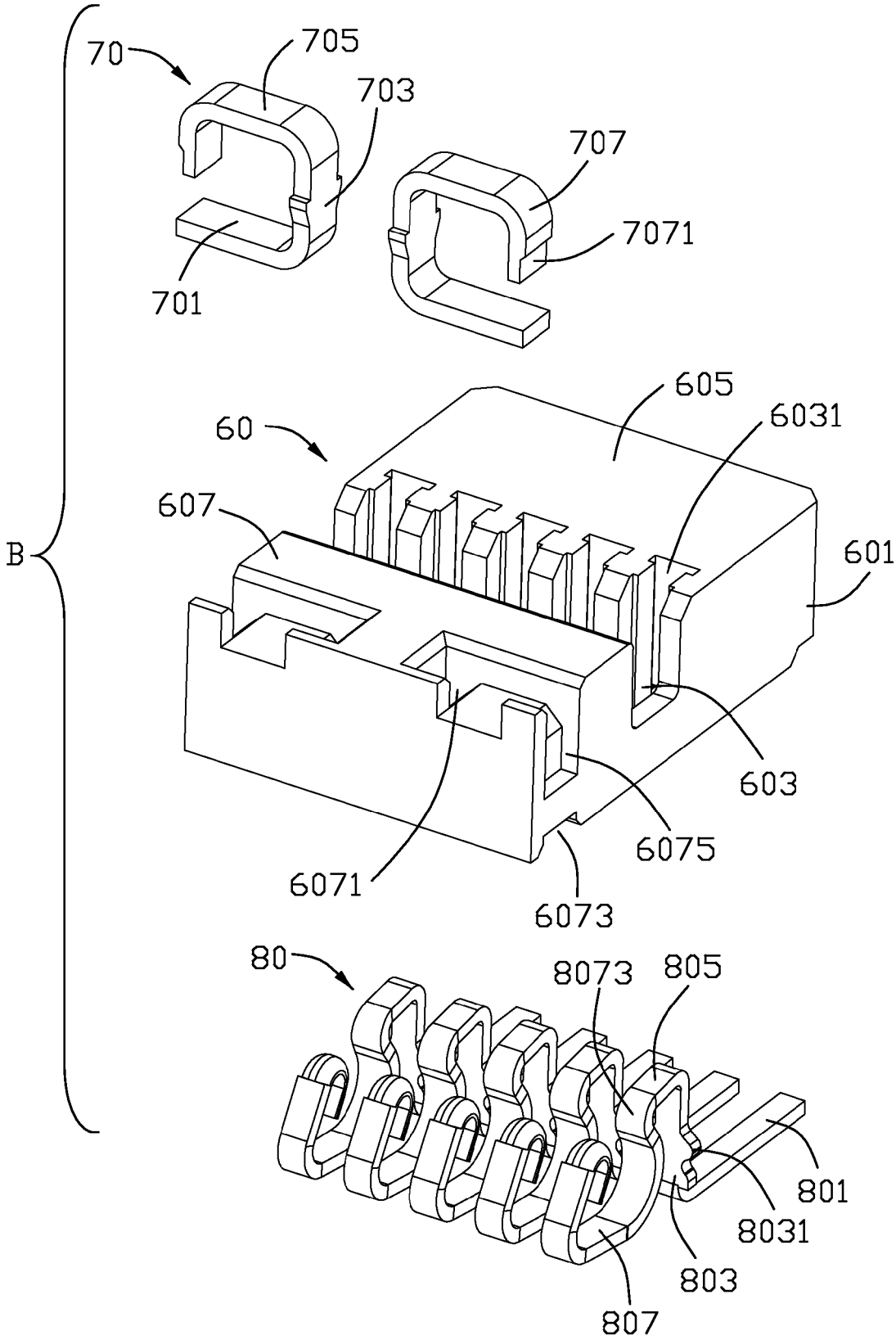
FIG. 8 is an exploded view of the second connector.
Figure 9:
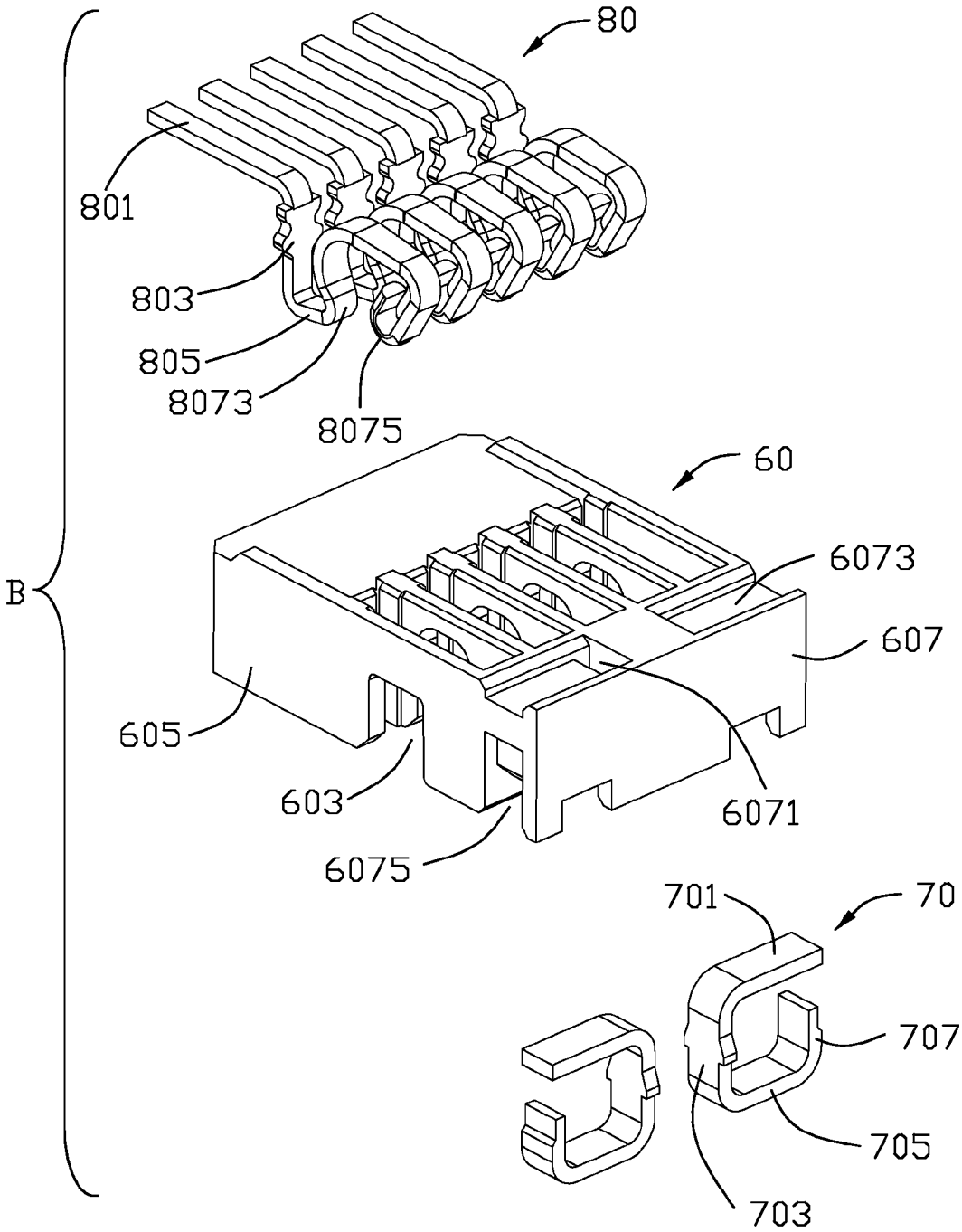
FIG. 9 is another exploded view of the second connector.
Figure 10:
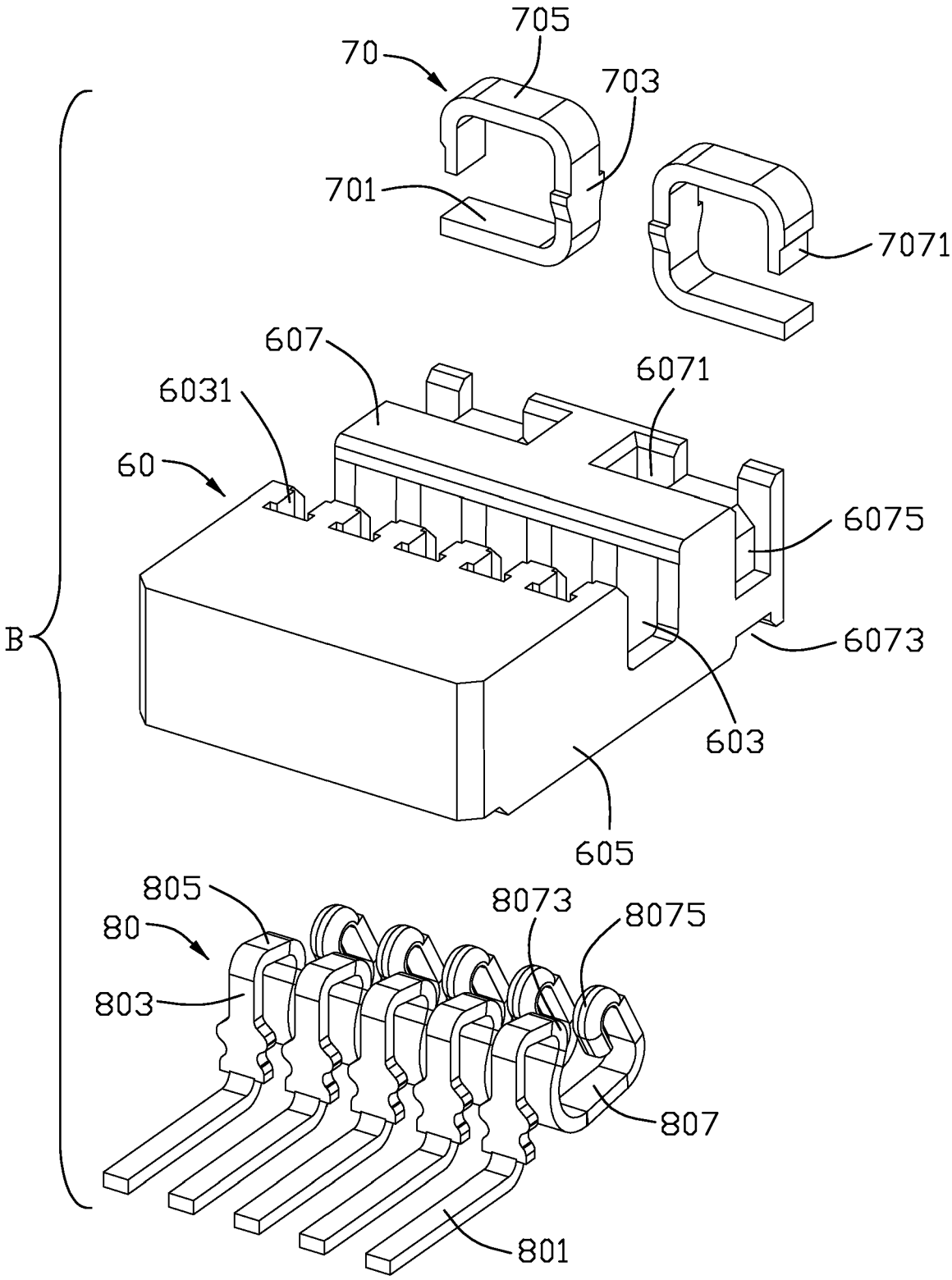
FIG. 10 is another exploded view of the second connector.
Figure 11:
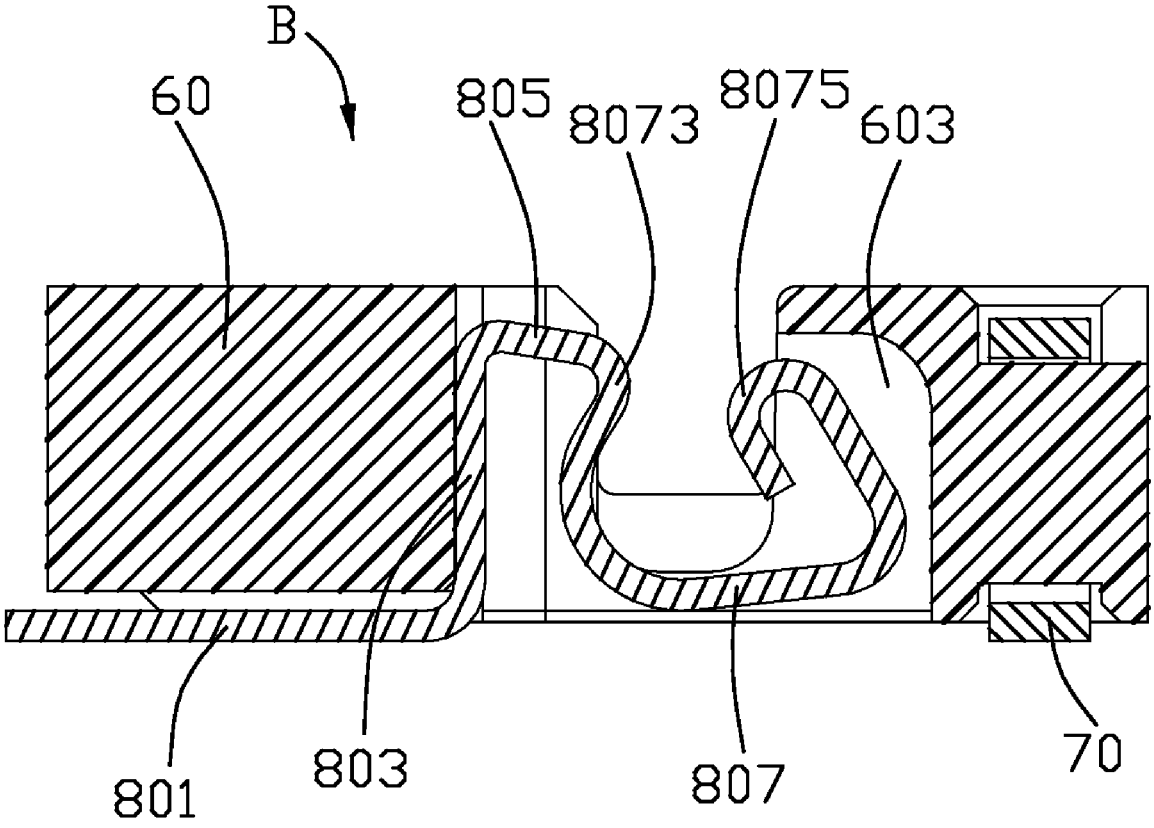
FIG. 11 is a cross-section view along line 11-11 of FIG. 1.
Figure 12:
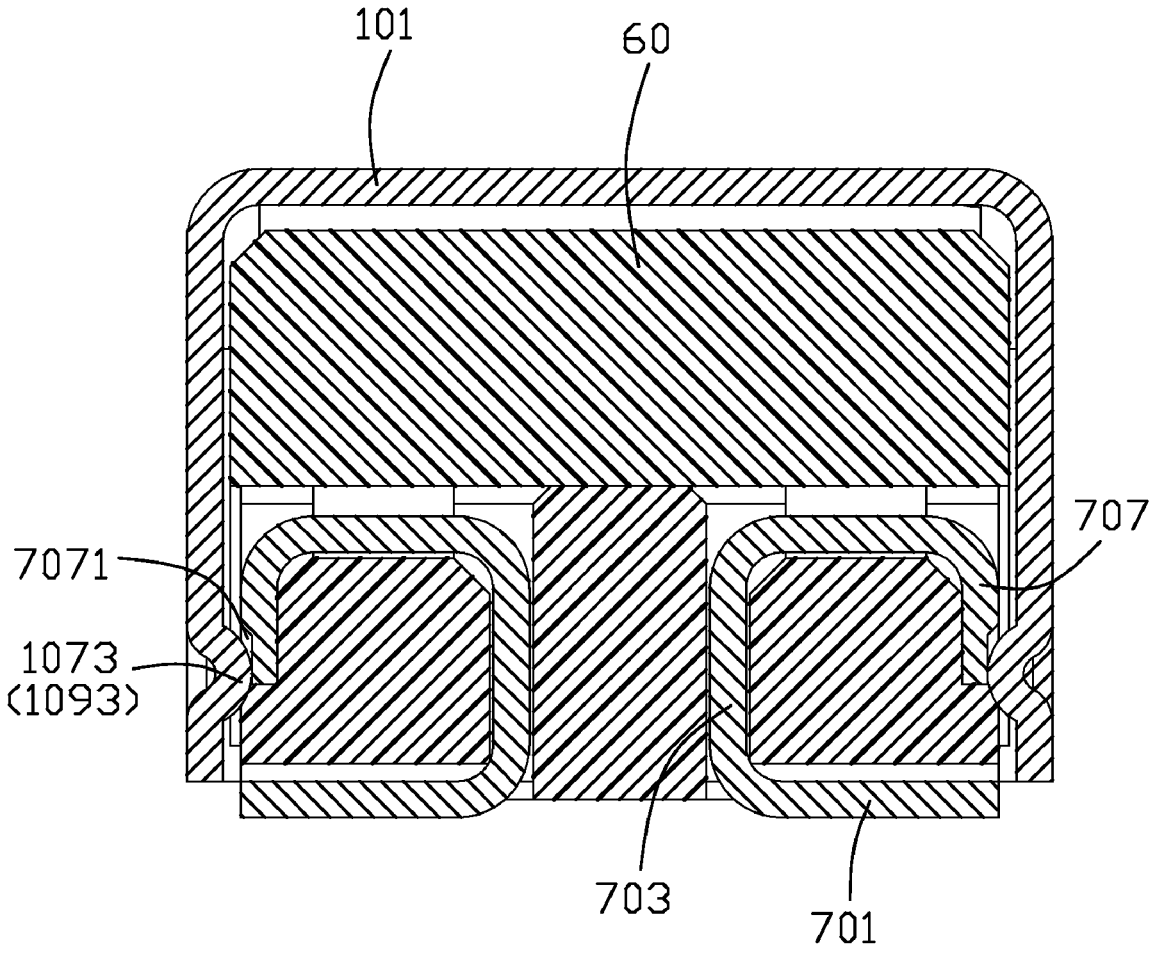
FIG. 12 is a cross-section view of the electrical connector assembly according to the embodiment of the present invention.

Please particular to FIGS. 6, 8 and 12, because each of the first and second housing 20 and 60 has no side wall, therefore, after the first and second connector A and B are assembled together, the contacting point 7071 can contact with the protrude 1073.

In the second embodiment, the most elements thereof is same to that of said embodiment besides the second connector B, therefore, hereafter the second connector B is only be described. The second connector B' comprises a second housing 60' with a plurality of second terminal contacts 80' and a pair of grounding elements 70'. Wherein the grounding element includes a straight section 703' retained into the second housing 60' and a contacting point 7071' exposed on outside adapted to contact with the protrude 1073 or 1093 of the metallic shell 10.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly comprising:

a first connector comprising:

a first housing having a bottom plate, a side plate extending uprightly from an end edge of the bottom plate and a divided plate extending from a middle section of the bottom plate and parallel to the side plate;

a plurality of first contacts including signal contacts and grounding contacts retained in the divided plate, each comprising a tail section disposed on a bottom surface of the bottom plate and a U-shaped section with first and second legs exposed on two side surfaces of the divided plate;

a plurality of cables electrically connected to the signal contacts;

a shield shell covering the first housing; and a second connector comprising:

a second housing defining a slot;

a plurality of second contacts interconnected with the first contacts;

a metal grounding pad assembled to the second housing with a mounting portion extending outside from a bottom surface of the second housing, the metal grounding pad comprising a horizontal section parallel to the mounting portion, a linking section formed between the mounting portion and the horizontal section and extended uprightly, and a contacting section extending from an distal end of the horizontal section and parallel to the linking section; wherein the contacting section is electrically connected with the shield shell.

2. The electrical connector assembly as claimed in claim 1, wherein the metal grounding pad defines a concave section engaging with a dimple formed on the shield shell.

3. The electrical connector assembly as claimed in claim 1, wherein the metal grounding pad comprises a retaining section fixed into the second housing.

4. The electrical connector assembly as claimed in claim 1, wherein each of the second contacts includes a second tail section, an upright section interconnected with the second tail portion, a U-shaped contact engaging section, and a bridge section disposed between the upright section and the U-shaped contact engaging section.

5. The electrical connector assembly as claimed in claim 4, wherein when the first and the second connectors are engaged together, the U-shaped sections of the signal contacts and the grounding contacts of the first connector are inserted into a center of the U-shaped contact engaging section of the second contacts.

6. An electrical connector assembly comprising:

a first connector comprising:

a first housing having a bottom plate, a side plate extending uprightly from an end edge of the bottom plate and a divided plate extending from a middle section of the bottom plate and parallel to the side plate;

a plurality of first contacts including signal contacts and grounding contacts retained in the divided plate, each comprising a tail section disposed on a bottom surface of the bottom plate and a U-shaped section with first and second legs exposed on two side surfaces of the divided plate;

a plurality of cables electrically connected to the signal contacts;

a shield shell covering the first housing; and a second connector comprising:

a second housing defining a slot;

a plurality of second contacts interconnected with the first contacts;

a metal grounding pad assembled to the second housing with a mounting portion extending outside from a bottom surface of the second housing; wherein the metal grounding pad is electrically connected with the shield shell; further comprising a grounding bar assembled to the cable and the grounding contacts of the first connector.

7. The electrical connector assembly as claimed in claim 6, wherein the grounding bar is board-shape and has a semicircle recess adapted for retaining the cables.

8. The electrical connector assembly as claimed in claim 7, wherein the first housing defines a plurality of signal contact passages and grounding contact passages on a bottom surface thereof.

9. The electrical connector assembly as claimed in claim 8, wherein the first housing defines a grounding bar passageway on the bottom plate and intersecting with the signal contact passages and the grounding contact passages.

10. The electrical connector assembly as claimed in claim 6, wherein when mated, the shell protectively covers the second connector including the grounding pad.

11. The electrical connector assembly as claimed in claim 10, wherein the grounding pad defines a recess and the shell defines a boss received in said recess.

12. An electrical connector assembly comprising:

a first connector comprising:

a first housing having a bottom plate, a side plate extending uprightly from an end edge of the bottom plate and a divided plate extending from a middle section of the bottom plate and parallel to the side plate;

a plurality of first contacts including signal contacts and grounding contacts retained in the divided plate, each comprising a tail section disposed on a bottom surface of the bottom plate and a U-shaped section with first and second legs exposed on two side surfaces of the divided plate;

a plurality of cables electrically connected to the signal contacts;

a shield shell covering the first housing; and a second connector comprising:

a second housing defining a slot;

a plurality of second contacts interconnected with the first contacts;

a metal grounding pad assembled to the second housing with a mounting portion extending outside from a bottom surface of the second housing; wherein the metal grounding pad is electrically connected with the shield shell; wherein the shield shell defines a plurality of grounding pads to engage with the grounding contacts of the first contacts.

13. The electrical connector assembly as claimed in claim 12, wherein when mated, the shell protectively covers the second connector including the grounding pad thereof.

14. The electrical connector assembly as claimed in claim 13, wherein the grounding pad defines a recess and the shell defines a boss received in said recess.

* * * * *